US005868008A

United States Patent [19]

Yamaura et al.

[11] Patent Number: 5,868,008

[45] Date of Patent: Feb. 9, 1999

[54] ORNAMENTS USING JEWELS

[75] Inventors: Hiroyoshi Yamaura, 12-27-411, Toneyamamotomachi, Toyonaka-shi, Osaka, Japan, 560; Kazuhide Ueki, Kawachinagano; Tatsuo Nakata, Sakai, both of Japan

[73] Assignee: Hiroyoshi Yamaura, Osaka, Japan

[21] Appl. No.: 682,754

[22] PCT Filed: Feb. 13, 1995

[86] PCT No.: PCT/JP95/00212

§ 371 Date: Jul. 31, 1996

§ 102(e) Date: Jul. 31, 1996

[87] PCT Pub. No.: WO95/21552

PCT Pub. Date: Aug. 17, 1995

[30] Foreign Application Priority Data

| | | | |
|---|---|---|---|
| Feb. 14, 1994 | [JP] | Japan | 6-003865 U |
| Feb. 14, 1994 | [JP] | Japan | 6-003866 U |
| Feb. 25, 1994 | [JP] | Japan | 6-004305 U |
| May 20, 1994 | [JP] | Japan | 6-107019 |

[51] Int. Cl.[6] ..... A44C 9/00; A44C 17/00

[52] U.S. Cl. ..... 63/15; 63/32

[58] Field of Search ..... 63/26, 28, 27, 63/32, 15

[56] References Cited

U.S. PATENT DOCUMENTS

| | | | |
|---|---|---|---|
| 2,596,965 | 5/1952 | Troy | 63/26 X |
| 4,878,364 | 11/1989 | Freilich | 63/28 |
| 4,936,115 | 6/1990 | Mesica | 63/28 X |
| 5,323,300 | 6/1994 | McCrary | 63/2 X |
| 5,664,440 | 9/1997 | Roemer | 63/15 |

FOREIGN PATENT DOCUMENTS

| | | |
|---|---|---|
| 56-30018 | 3/1981 | Japan . |
| 2-144500 | 12/1990 | Japan . |

*Primary Examiner*—Kien T. Nguyen
*Attorney, Agent, or Firm*—Wenderoth, Lind & Ponack, LLP

[57] ABSTRACT

A jewelry ornament includes a jewelry ring having a base having a hole formed in a central portion thereof. A prong mount extends from the base, and a transparent or semi-transparent gem is held by the prong mount. A colored back-up material is at least partially positioned in the hole.

13 Claims, 3 Drawing Sheets

ORNAMENTS USING JEWELS

BACKGROUND OF THE INVENTION

The present invention relates to an ornament such as a ring or pendant having a gem, e.g., a diamond.

Jewelry ornaments including rings and pendants are made precious and valuable by including diamonds and other gems.

A diamond is one of the most popular gems and its quality is graded by the factors of color, clarity (or inclusions), cut (polishing) and weight (measured in karats). If a diamond contains a significant amount of impurities or flaws, it is graded for industrial use. The cut is commonly a 58-facet brilliant cut. FIG. 9 illustrates a faceted diamond including a pavilion vertex 11, a crown 12, a table 13, and a pavilion 14. The pavilion 14 has a cutlet provided at the vertex thereof. Natural diamonds rarely are pure crystal, pink or blue in color. Such highly graded colored diamonds are precious and admirable and will thus be enormously expensive.

It is understood that if low grade, inexpensive diamonds having a brown or yellow tint are successfully turned to pink or blue in color or to clear transparency, their value is increased and they may be used as jewelry. Techniques have been introduced for turning low grade, yellowish colored diamonds to other favorable colors by exposing them to radioactive rays. However, radioactive-ray tinted or industrially treated diamonds are classified as non-natural gems and fail to be accompanied by written certifications which are essential for marketing.

SUMMARY OF THE INVENTION

It is an object of the present invention to provide a jewelry ornament including a precious stone or gem that is not artificially treated but that is backed by a colored material for correction of its original color so that it appears to have a higher graded color.

In accordance with the present invention, a jewelry ornament includes a transparent or semi-transparent gem and a colored back-up material disposed behind the gem. The colored back-up material may be a colored gem. The gem may be a polished diamond, and the colored back-up material may be disposed directly beneath the vertex of a pavilion of the diamond. The colored backup material may have a recess provided therein and the pavilion vertex of the diamond may be fitted into the recess. The diamond may be spaced by a small gap from the colored back-up material. The gap between the diamond and the colored back-up material may be filled with a transparent or semi-transparent material. Also, the transparent or semi-transparent material may be applied about a joint between the diamond and the colored back-up material.

Since the jewelry ornament includes the colored back-up material disposed behind the transparent or semi-transparent gem, when the jewelry ornament is viewed from the front (i.e., from the direction denoted by the arrow in FIG. 9), it appears to have a hue imparted by the color of the back-up material and does not appear to have its original color. Since any desired colored gem may be used as the colored material, the combination of the two stones provides an improved appearance.

When the colored back-up material is disposed directly beneath the pavilion vertex of a polished diamond, when the jewelry ornament is viewed from the front, its diamond appears to have a hue affected by the color of the back-up material and is corrected from its original color. Similarly, when the pavilion vertex of the polished diamond is fitted with into the recess provided in the colored back-up material, when the diamond is viewed from the front, it appears to have a hue affected by the color of the back-up material and is corrected from its original color.

Also, when a gap is provided between the pavilion vertex of the diamond and the colored back-up material, when the jewelry ornament is viewed from the front, the diamond appears to have a hue affected by the color of the back-up material and is substantially corrected from its original color. When the gap provided between the pavilion vertex of the diamond and the colored back-up material is filled with the transparent or semi-transparent material, the diffusion of light is minimized so that the color of the back-up material is favorably focused on the pavilion vertex of the diamond. When the jewelry ornament is viewed from the front, the diamond appears to have a hue of the color of the back-up material and is significantly corrected from its original color. Although the joint between the pavilion vertex of the diamond and the colored back-up material is very small in extension, it is reinforced with the transparent or semi-transparent material which in turn increases the area of interface. This increased interface area allows the color of the back-up material to be intensively transmitted through the pavilion vertex of the diamond. Thus, the diamond is directly backed up by the intensity of the back-up material color and its hue will be improved.

The back of a gem or the pavilion vertex of a polished diamond may be tinted in a desired color. When the jewelry ornament is viewed from the front, the gem or diamond appears to have a hue derived from the tinted color on the back and is corrected from its original color.

A mount of the jewelry ornament may be painted a desired color at an inner surface thereof. When it is viewed from the front, the gem or diamond on the mount appears to have a hue affected by the painted color and is corrected from its original color.

DETAILED DESCRIPTION OF THE INVENTION

A jewelry ornament according to the present invention in the form of rings shown in the accompanied drawings now will be described.

First Embodiment

Figure 1:
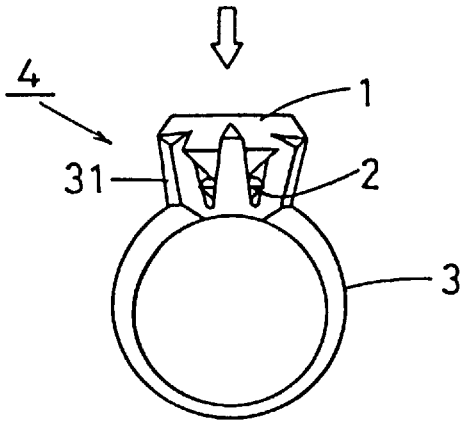
FIG. 1 is a side view of a jewelry ornament in the form of a ring according to the present invention.
Figure 2:
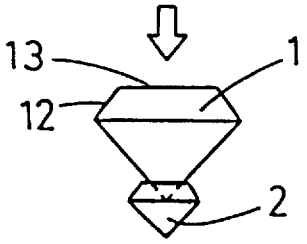
FIG. 2 is a side view showing a primary part of the ring.
Figure 3:
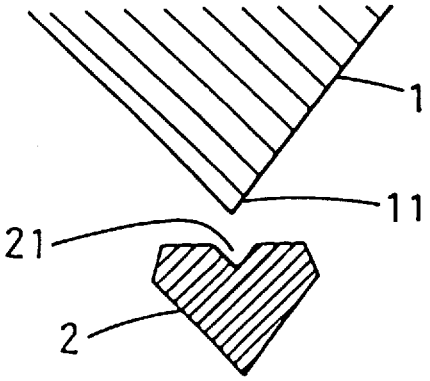
FIG. 3 is a cross sectional view of the primary part of the ring.

FIG. 1 is a side view of a ring 4 of the present invention, and FIGS. 2 and 3 are a side view and a cross sectional view of a primary region thereof. Denoted by 1 in FIGS. 1, 2 and 3 is a low grade diamond with a brilliant cut. A blue sapphire 2 has a recess 21 provided in the top center thereof. The sapphire 2 is fitted in a hole 3*a* (FIGS. 4 and 5) in a base of a jewelry ring from which extend prongs of a prong mount 31 of the jewelry ring 3. A pavilion vertex 11 of diamond 1 is tightly fitted into the recess 21 of the sapphire 2. More particularly, the diamond 1 is secured over the sapphire 2 to define two layers therewith.

The blue color of the sapphire 2 is reflected through the pavilion vertex 11 of the diamond 1 to crown 12 and table 13 thereof. This allows the diamond 1 on the ring 4 to be viewed as blue in color. In other words, the diamond 1 of a low color grade is observed as if it is a high grade diamond. The diamond itself is not dyed or tinted and comes with an appropriate certificate, thus not affecting its market value.

When a moderate grade diamond which has a certain degree of commercial value is assembled to a jewelry ornament according to the present invention, it appears to have a favorable suggestive of a natural, high grade diamond.

Second Embodiment

Another embodiment of the present invention, in the form of a ring having a diamond and a blue sapphire in a different combination, now will be described.

Figure 4:
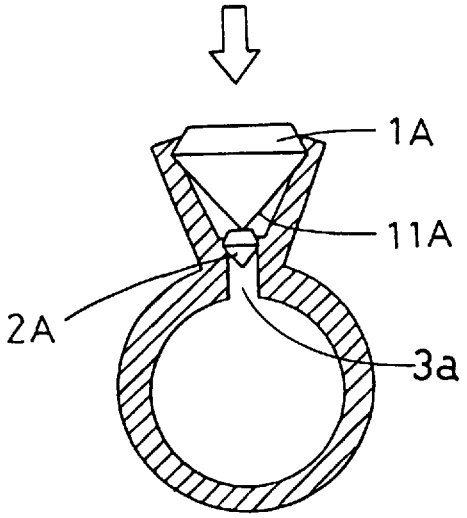
FIG. 4 is a partial cross sectional side view showing another embodiment of the ring.

FIG. 4 is a partial cross-sectional side view of the ring of this embodiment. A pavilion vertex 11A of a diamond 1A is joined directly to the upper surface of a sapphire 2A. Since the sapphire 2A does not have a recess, the ring may be fabricated with greater ease than the embodiment shown in FIGS. 1–3. The blue color of the sapphire 2A still is reflected towards the diamond 1A which thus is observed as blue in color.

Figure 6A:
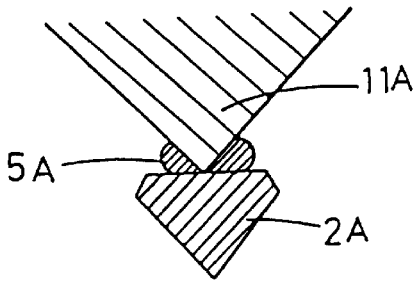
FIG. 6A is a cross sectional view showing a transparent or semi-transparent material applied to a joint between a diamond and a sapphire.

When an amount of transparent or semi-transparent resin material 5A is applied close to and about the joint between the pavilion vertex 11A of the diamond 1A and the sapphire 2A, as shown in FIG. 6A, an apparent area of the joint therebetween is increased, thus promoting the transmission of the blue color from the sapphire 2A.

Third Embodiment

A further embodiment of the present invention, in the form of a ring in which a diamond is spaced by a small distance from a blue sapphire, now will be described.

Figure 5:
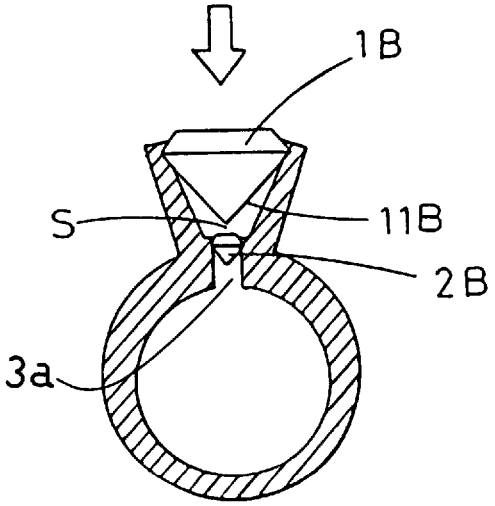
FIG. 5 is a partial cross sectional side view showing a further embodiment of the ring.

FIG. 5 is a partial cross-sectional side view of the ring of the third embodiment. A clearance S is provided between pavilion vertex 11B of a diamond 1B and the upper surface of a sapphire 2B. The clearance S provides ease of assembly without requiring critical accuracy. If the clearance S is not provided, the lower colored material, i.e., the sapphire, has to be precisely positioned beneath the pavilion vertex of the upper member, i.e., the diamond. Such precise positioning without any margin for error is extremely difficult, and any abrupt contact of the lower member with the pavilion vertex may cause breakage or damage. Also, the pavilion vertex is fragile and may be fractured if stressed by an external force during normal use.

Figure 6B:
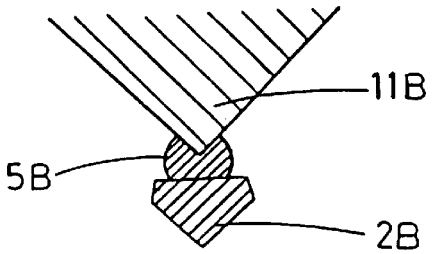
FIG. 6B is a cross sectional view showing a gap between a diamond and a sapphire filled with transparent or semi-transparent material.

It is possible to fill the clearance S with a dose of transparent or semi-transparent resin material 5B, as shown in FIG. 6B, which also serves as an adhesive. The resin material 5B increases the joint area between the pavilion vertex 11B of the diamond 1B and the sapphire 2B, thus promoting the transmission of the blue color from the sapphire 2B to the diamond 1B.

The construction of this embodiment is easier during assembly than the embodiment shown in FIGS. 1–4, regardless of different sizes of the gems. The two, i.e., upper and lower, gems can be joined to each other by the resin adhesive material.

When no air gap exists between the pavilion vertex 11B of the diamond 1B and the sapphire 2B, diffusion of light at the interface will be reduced, thus allowing highly effective transmission of the blue color of the sapphire 2A to the diamond 1B. Accordingly, the diamond 1B appears to have a blue color, and its quality will appear to be similar to a high grade colored diamond.

Figure 7:
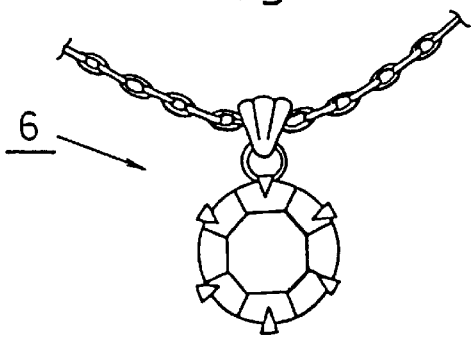
FIG. 7 is a front view of a jewelry ornament in the form of a pendant according to the present invention.
Figure 8:
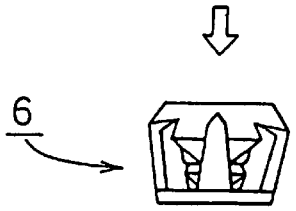
FIG. 8 is a side view of the pendant.
Figure 9:
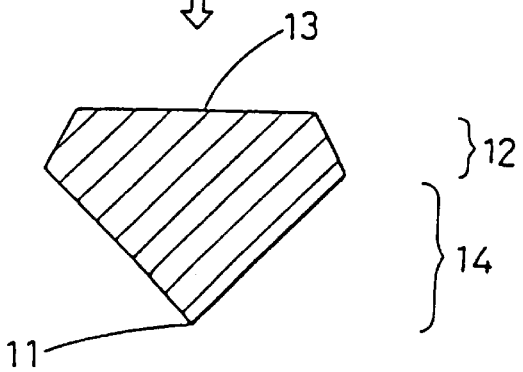
FIG. 9 is a cross sectional view explaining various sections of a faceted diamond.

The embodiment with a combination of diamond and blue sapphire is not limited to the ring and may be a pendant 6 as shown in FIGS. 7 and 8.

The sapphire may have a recess in the upper surface thereof or be spaced from the diamond by a gap which is filled with a transparent or semi-transparent resin material. Even if the gap is not intentionally provided, a small space exists therebetween and preferably is filled with a transparent or semi-transparent resin material.

It would be understood that the present invention is not limited to the rings and pendants of the foregoing embodiments but may be applied to earrings, bracelets, and other ornaments.

The present invention allows any yellowish colored diamond to be rendered by the color of a back-up gem so that it has the appearance of a colored higher grade diamond. Any gems or stones that are properly polished and faceted, other than diamonds, may be backed up by desired colored materials for correction of tints. The colored material is not limited to sapphires, but other desired deep color gems, including rubies, may be employed with equal success.

The front or upper diamond or gem may be tinted directly on its back facets without using a back-up colored material. This eliminates the need for a back-up material, and the back of the jewelry ornament will be free, thus contributing to ease of assembly. It is also possible to color the inner wall of the prong mount. In such case, the front or upper diamond or gem need not be effected, and thus retain its commercial value.

The transparent or semi-transparent gem of a jewelry ornament when viewed from the front is tinted by the color of a back-up material to have a desired hue without being treated with radioactive rays, and its color appearance can be controlled with regard to hue. As a result, any low grade gem may be made to appear as if it is a colored higher grade gem. The gem itself remains intact without any particular treatment, its commercial value will never be affected, and its certificate will remain unchanged.

The jewelry ornament may employ a colored gem as the colored back-up material. As a result, a pair of gems are fitted one over the other, thus contributing to improved appearance of the jewelry ornament.

The colored back-up material can be positioned directly beneath the pavilion vertex of a polished diamond which thus appears to have a favorable hue. Any low grade diamond will be viewed as if it is a colored higher grade diamond. Also, the diamond is not exposed to the intensity of radioactive rays and thus can come with an original certificate stating it is a genuine, untreated gem.

The pavilion vertex of the diamond of the jewelry ornament can be fitted into a recess provided in the colored back-up material and thus be tinted by the color thereof. The color visible through the diamond thus may be determined to be a desired hue or tint.

The pavilion vertex of a diamond in the jewelry ornament may be spaced by a gap from the colored back-up material to allow ease of assembly. The gap prevents the pavilion vertex of the diamond from contacting and injuring the colored material.

A transparent or semi-transparent material may be applied to about the joint or fill the gap between the pavilion vertex of the diamond and the colored back-up material. The color of the back-up material is more dissipated through the transparent or semi-transparent material, and thus will be highly visible at the front of the diamond. Also, fabrication of the ornament will be facilitated.

The pavilion of a polished diamond or the back of a gem in the jewelry ornament may be directly tinted. This eliminates the need for the colored back-up material. Thus, the overall arrangement of the ornament will be simple, and the ornament can be assembled with ease.

The jewelry ornament may have a mount thereof painted on its inner surface. An extra step of processing a gem or diamond thus will be eliminated.

What is claimed is:

1. A jewelry ornament comprising:

a jewelry ring having a base having a hole formed in a central portion thereof, and a prong mount extending from said base;

a transparent or semi-transparent gem held by said prong mount; and a colored back-up material at least partially positioned in said hole, said colored back-up material comprising a colored gem.

2. A jewelry ornament as claimed in claim 1, wherein said colored back-up material is smaller than said transparent or semi-transparent gem and is surrounded by a wall of said hole, such that said colored back-up material substantially is not visible from the exterior of said jewelry ornament.

3. A jewelry ornament as claimed in claim 1, wherein said transparent or semi-transparent gem comprises a polished diamond having a pavilion vertex.

4. A jewelry ornament as claimed in claim 3, wherein said colored back-up material is positioned directly beneath said pavilion vertex.

5. A jewelry ornament as claimed in claim 3, wherein said pavilion vertex is positioned in a recess in said colored back-up material.

6. A jewelry ornament as claimed in claim 3, wherein said pavilion vertex is spaced by a gap from said colored back-up material.

7. A jewelry ornament as claimed in claim 6, further comprising a transparent or semi-transparent material filling said gap.

8. A jewelry ornament as claimed in claim 3, further comprising a transparent or semi-transparent material applied about a joint between said diamond and said colored back-up material.

9. A jewelry ornament as claimed in claim 1, wherein said transparent or semi-transparent gem is spaced by a gap from said colored back-up material.

10. A jewelry ornament as claimed in claim 9, further comprising a transparent or semi-transparent material filling said gap.

11. A jewelry ornament as claimed in claim 1, further comprising a transparent or semi-transparent material applied about a joint between said transparent or semi-transparent gem and said colored back-up material.

12. A jewelry ornament as claimed in claim 1, wherein said colored back-up material is applied directly to a back portion of said transparent or semi-transparent gem.

13. A jewelry ornament as claimed in claim 11, wherein said hole is located centrally of prongs of said prong mount.

* * * * *